United States Patent [19]

Therond

[11] Patent Number: 4,499,728

[45] Date of Patent: Feb. 19, 1985

[54] HYDRAULIC PRESS MECHANISM

[76] Inventor: Marcel P. Therond, 8c, Chemin de Balme Baron, 69140 Rillieux-La-Pape, France

[21] Appl. No.: 317,902

[22] PCT Filed: Mar. 11, 1981

[86] PCT No.: PCT/FR81/00034

§ 371 Date: Oct. 30, 1981

§ 102(e) Date: Oct. 30, 1981

[87] PCT Pub. No.: WO81/02543

PCT Pub. Date: Sep. 17, 1981

[30] Foreign Application Priority Data

Mar. 12, 1980 [FR] France ..... 80 05955

[51] Int. Cl.[3] ..... F15B 7/00

[52] U.S. Cl. ..... 60/570; 60/583; 60/589; 60/591; 60/593; 60/594

[58] Field of Search ..... 60/565, 593, 591, 570, 60/583, 589, 594, 568

[56] References Cited

U.S. PATENT DOCUMENTS

| | | | |
|---|---|---|---|
| 1,659,157 | 2/1928 | Prouty | 60/565 |
| 3,059,433 | 10/1962 | Hirsch | 60/565 |
| 3,266,415 | 8/1966 | Palmer | 60/593 |
| 3,830,061 | 8/1974 | Severinsson | 60/593 |
| 4,249,380 | 2/1981 | Melendy | 60/591 |
| 4,271,671 | 6/1981 | Smeets | 60/593 |
| 4,288,987 | 9/1981 | Grüllmeier | 60/593 |
| 4,300,351 | 11/1981 | Grüllmeier | 60/593 |

FOREIGN PATENT DOCUMENTS

| | | | |
|---|---|---|---|
| 2452221 | 5/1976 | Fed. Rep. of Germany | 60/593 |
| 1152415 | 6/1956 | France | 60/591 |

*Primary Examiner*—Abraham Hershkovitz
*Attorney, Agent, or Firm*—Karl F. Ross

[57] ABSTRACT

This mechanism makes it possible to obtain in succession a fast approach stroke (C), and then a work stroke with a substantial developed stress, in operations such as riveting or marking, the work stroke being started as the tool (16) comes into contact with the part to be pressed (25). A control stem (4) and a body (9) are movable along one and the same axis (3), means such as a clack (31) providing for their non permanent locking. The stem (4) is integral with a primary piston (8) penetrating into a hydraulic circuit (10, 11) of the body (9); this circuit communicates, on the one hand, with an expansible casing (19) surrounding the body (9) and making it possible to block this body with respect to the frame (1), and on the other hand, with a chamber (12) in which a secondary piston (15), drawn back by a spring (18) and integral with tool (16), slides.

8 Claims, 8 Drawing Figures

5
6
4
23
22
8
35
13
7
14
26
3
9
10
30
1
2
20
31
29
32
21
19
15
11
12
18
16
17
C
25

HYDRAULIC PRESS MECHANISM

CROSS REFERENCE TO RELATED APPLICATIONS

This application is a national phase application corresponding to PCT No. FR 81/00034 filed Mar. 11, 1981 under the Patent Cooperation Treaty and in turn based upon French Application No. 80 05 955 filed Mar. 12, 1980 under the International Convention (the priority of which is claimed).

FIELD OF THE INVENTION

This invention relates to a hydraulic press mechanism and, more particularly, to a mechanism providing, in succession, a fast approach stroke and then a work stroke with a substantial developed stress, in operations such as riveting, marking, clamping and, more generally, in any operations in which the work stroke can be relatively short by comparison with the approach motion.

BACKGROUND OF THE INVENTION

Presently known hydraulic press mechanisms often consist of a single movable piston. In order to have an approach stroke, it is necessary, in that case, to displace all more hydraulic fluid as this stroke is greater. This can essentially be accomplished only by a pump, i.e., by a device which is complex with respect to the simplicity of the jack itself. Displacement of the fluid with a manual pump has to be effected using a large number of manoeuvers which of course make the operation slow and impractical.

Certain known devices provide a substantial and rapid approach displacement but require for this purpose a second jack and corresponding distribution chambers in order to transport the fluid.

Certain existing presses provide a fast approach stroke by means of the high flow rate of a low pressure pump, and a slow work stroke by means of the low flow rate of a high pressure pump. The feeding and control device, in the latter case, is costly with regard to the desired result.

Finally, certain devices are known which provide the same results at the price of greater complexity, for, in particular, control can only be effected using compressed air which must be introduced in several places of the device.

OBJECTS OF THE INVENTION

The object of this invention is to overcome all of these disadvantages by providing a press mechanism whereby, by application of a moderate stress at a single point of the device, a fast approach stroke is first induced until the tool comes into contact with the part to be pressed, and then from this point on, a work stroke is provided during which the device multiplies by itself the stress exerted, so that the part is subjected to the large stress desired. The invention also aims to achieving other results, in particular, use of an entirely hydraulic operation, by providing an automatic compensation of volume variations in the fluid related, for example, to operational leaks of the seals, these leaks becoming substantial when the device has gone through several hundred thousand operations and when a very fluid oil is used in order to obtain a high operational speed.

SUMMARY OF THE INVENTION

To this effect, the invention provides a hydraulic mechanism comprising a stem, on which the control action of the device is exerted, and a main body, which can be moved along one and the same axis in a fixed guiding bore, means being provided for the non permanent releasable locking of the body with respect to the stem, said body comprising a chamber filled with an incompressible fluid, in which a primary piston penetrates extending said stem, this chamber communicating, on the one hand, with an expansible casing axially immobilized around the body and which can be pressed against the wall of the previously mentioned bore so as to block the body with respect to the bore and, on ther other hand, with a cylindrical chamber in which is slidingly mounted a secondary piston, the latter being integral with a work tool and subjected to the action of a return spring.

The mechanism thus defined can cause the tool to describe an approach stroke followed by a work stroke, while being controlled only by a member which will be known in this disclosure as a stem, the work stroke being started at the time at which the tool comes into contact with the part to be pressed. This result is obtained by the blocking of the main body in the bore, through a means (expansible casing) going into operation when the tool, coming into contact with the part to be pressed, induces an axial displacement of the stem with respect to the body, which makes it possible for the primary piston to put the fluid circuit under pressure, thus inducing, on the one hand, the inflation of the expansible casing and, on the other hand, the advance of the secondary piston which causes then the tool to describe its work stroke. Previously, with regard to the approach stroke, the control stem and the body move forward simultaneously, due to the temporary locking obtained, for example, by means of an adjusted clack which closes the lower part of the first hydraulic chamber and thus prevents the incompressible fluid from leaving, in the direction of the expansible casing and of the second chamber, and thus preventing the primary piston from entering into this first chamber, so that the control stem carries along the entire body in its motion and, in particular, the secondary piston until the tube attached to the latter enters into contact with the object to be pressed. At this time, as the body becomes immobilized, if the primary piston simply continues to be pushed, it will force the clack to open as a result of the pressure it creates in the chamber. The control stem continues its stroke, the piston displaces oil under pressure beyond the adjusted clack towards the expansible casing and towards the secondary piston. The flexibility of the casing is such that it swells and gives rise to the blocking of the body with respect to the bore, before the secondary piston, held back, in partition, by its spring, moves forward with the large stress desired. The clack, as a result of the resistance it offers to the flow, opposes the penetration of the primary piston into the body and a permanent stress results which makes it possible to maintain a strong contact between the tool and the object to be pressed throughout the entire swelling phase of the casing, whatever the position of the device in space may be.

The large stress of the secondary piston is advantageously obtained by a "multiplication" effect provided by the incompressible fluid itself, by providing that the body chamber, in which is slidingly mounted the secondary piston integral with the tool, has a section which is greater than that of the primary piston linked to the control stem. However, as will easily be understood, the stress exerted on the tool must remain smaller than the blocking stress on the body of the bore.

After the tool has done its work, the control stem is brought backwards, which inversely first induces the return of the secondary piston and the unclamping of the main body with respect to the bore, and then the simultaneous return of the stem and the body, the previously mentioned clack being designed so that it allows the liquid to flow back towards the chamber from where it came.

In order to compensate for operational losses in the hydraulic seals which would hinder the normal operation of the device, the primary piston advantageously comprises, at the extremity thereof which is immersed in the chamber filled with fluid, a groove such that, when, the primary piston is in a drawn back position, and only in that position, said groove puts the body chamber in communication with a hydraulic fluid reserve, delimited by the bore in which the body slides and by a movable wall in said bore and pushed by a spring, so as to follow the variations of the fluid level without any chance of air entering into the hydraulic circuit. Variations in volume of the fluid contained in the useful part of the hydraulic circuit are thus automatically compensated from a cylindrical chamber acting as a reserve.

The control of the stem, integral with the primary piston which is in fact the only control of the device as a whole, can be obtained mechanically according to a first possibility by providing the control stem with a rack in meshing engagement with a driving pinion, the latter being mounted on a shaft manoeuvred by a member such as a lever, possibly by inserting a torque limiting device.

According to another possibility, the general control is either pneumatic or hydraulic. The entire mechanism can then be arranged along the same axis, by providing the frame with a cylinder, coaxial with the bore in which the body slides, an additional piston integral with the primary piston being slidingly mounted in said cylinder, comprising a pneumatic or hydraulic control cylinder.

Whatever the driving means (mechanical or other) may be, it is possible to provide, according to still another embodiment of the invention, for the displacement of the control member to occur in two successive manners: first, a translation for the approach motion of the assembly and then a rotation of this member making it possible to obtain the blocking of the body with respect to the bore and the work feed of the tool. To this effect, a control tube connected to the primary piston, slidingly mounted rotating in a bore of the frame, is linked through a threading on the body which is immobilized in rotation by means, the approach stroke being obtained by the simultaneous translation of the tube and the body, while the work stroke is obtained by screwing of the tube onto the body, said tube being manoeuvrable through a part adapted, preferably, through a torque limiting device. In the latter case, the threading ensures, when the approach motion occurs, the axial connection between the tube and the body and during the work stroke, an amplification of the stress.

BRIEF DESCRIPTION OF THE DRAWING

The invention will be more fully understood from the following description with reference to the appended schematic drawing showing, by way of non limiting examples, several embodiments of this hydraulic press mechanism.

SPECIFIC DESCRIPTION

Figure 1:
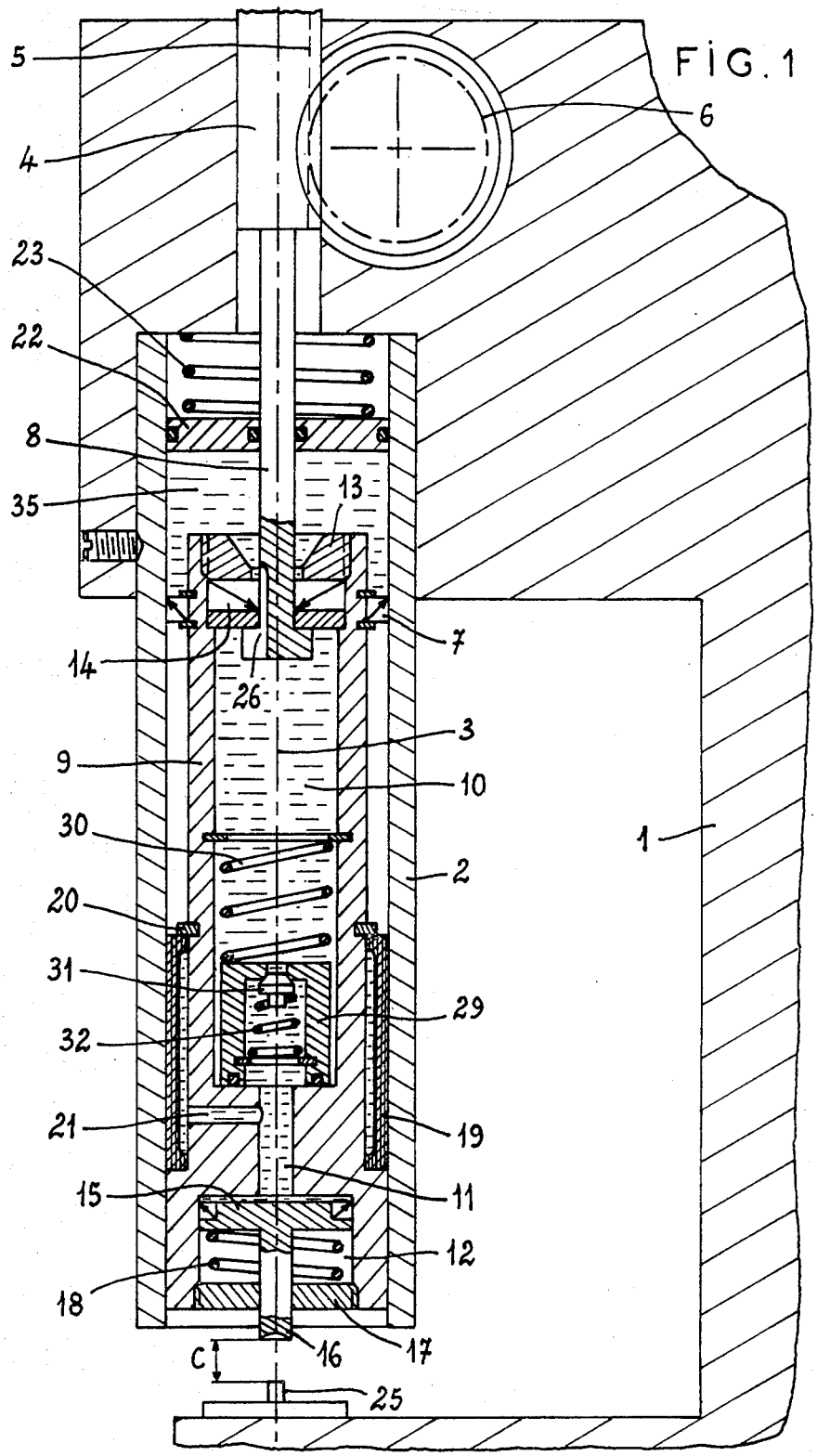
FIGS. 1, 2, 3 and 4 are sectional views of the mechanism according to the invention, in four successive positions, illustrating its principle of operation.
Figure 2:
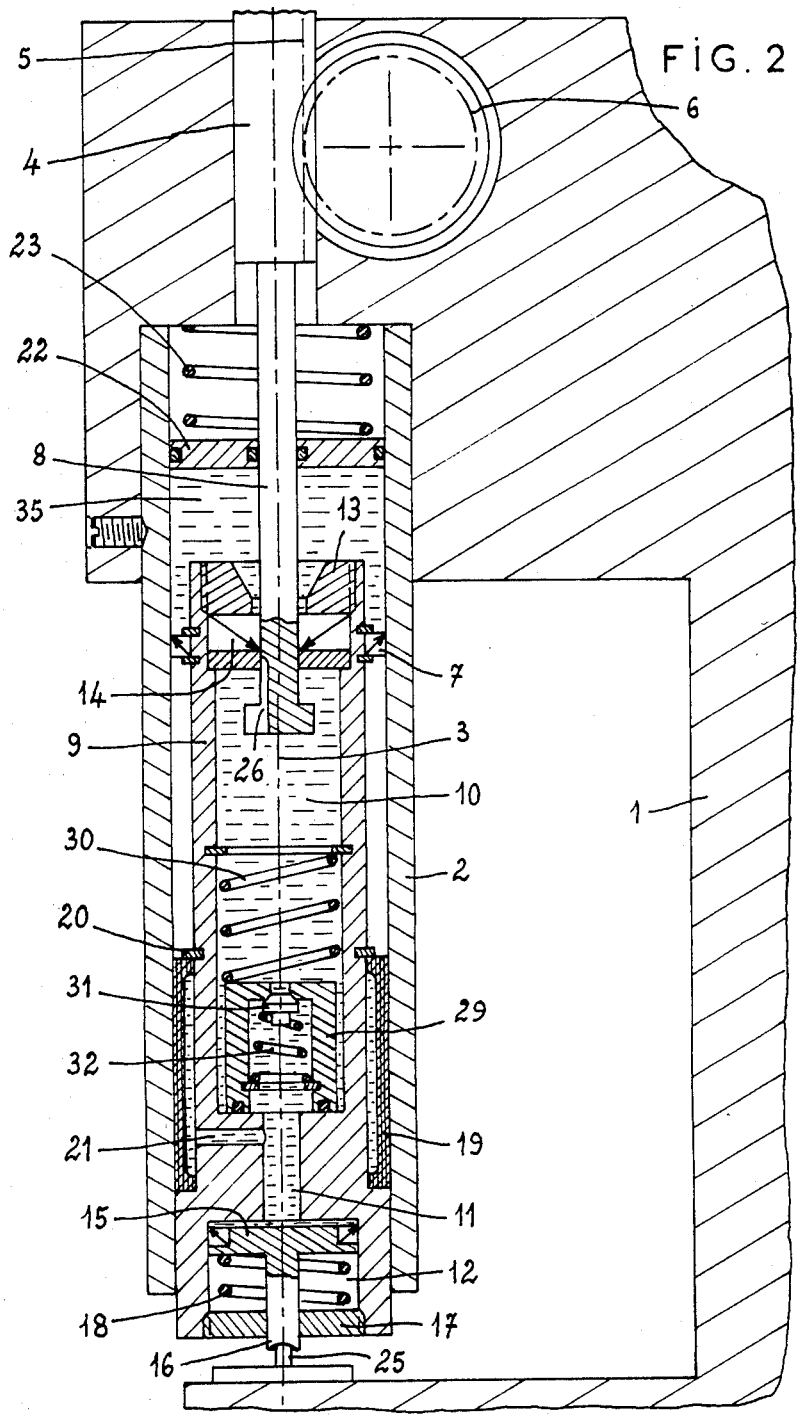

FIGS. 1 to 4 show a machine comprising a frame 1, on which is set a tube 2 with a vertical axis 3.

In the bore defined by this tube 2 is slidingly mounted a body 9 which supports an expansible casing 19, which is immobilized axially, on the one hand, by a shoulder separating the large diameter part of body 9 from a smaller diameter part and, on the other hand, by an annular stop member 20. The body 9 is recessed, so as to comprise an upper cylindrical chamber 10 connected by an intermediate channel 11 to a lower cylindrical chamber 12. At least one radial communication 21 connects channel 11 to the inside of casing 19, which is filled with incompressible fluid, in particular, oil. The chamber 12 contains a secondary piston 15 integral with a tool 16 crossing a threaded end part 17, a spring 18 being compressed between this end part 17 and the lower face of the secondary piston 15.

The upper chamber 10, channel 11 and part of the lower chamber 12 located above the secondary piston 15 are filled with the same incompressible fluid as the expansible casing 19.

A primary piston 8 penetrates into upper chamber 10, and has on its lower part, a longitudinal groove 26 having a length such that, when piston 8 is in an upper position (shown in FIG. 1), this groove 26 puts into communication chamber 10 and a chamber 35 filled with the same incompressible fluid and located above body 9. Chamber 35, which acts as a fluid reserve, is separated from chamber 10 by a seal 14, maintained by a ring 13 screwed on top of body 9 (seal 14 not fulfilling its function in the upper position of piston 8). Chamber 35 is delimited by still another seal 7 placed between body 9 and tube 2, by the internal wall of this tube 2 and by an upper movable end part 22, which is maintained applied against the surface of the fluid by means of a spring 23.

The primary piston 8, which crosses ring 13, chamber 35 and end part 22, is extended upwards by a control stem 4 which slides in a recess of frame 1. Stem 4 is provided with a rack 5, in meshing engagement with a driving pinion 6 mounted on a shaft manoeuvred, for example, through a lever, not shown.

In order to temporarily link primary piston 8, and control stem 4, which extends it, to body 9, a double clack device is provided in the embodiment shown in FIGS. 1 to 4, which temporarily seals the entrance of intermediate channel 11 located at the bottom of chamber 10, and as a result opposes the penetration of the primary piston 8 into said chamber 10. In the example of an embodiment more particularly described herein, one of the clacks is arranged inside the other: a first clack or valve 29, pushed downwards by a spring 30, acts as a housing for a second clack or valve 31, urged upwards by another spring 32.

Part 25 to be worked on, for example, to be flattened, is placed on frame 1, in axis 3 of the device previously described. In the initial position (FIG. 1), control stem 4 is raised; double clack 29–31 seals the entrance to channel 11 and opposes any displacement of fluid in the hydraulic circuit. The secondary piston 15 occupies, inside chamber 12, its highest position and tool 16, connected to secondary piston 15, is far removed from part 25.

In a first phase (see FIG. 2), stem 4 is pushed downwards through the action of pinion 6 which is itself manoeuvred by the above mentioned lever. Primary piston 8 penetrates through a short stroke into chamber 10, until groove 26, located at its lower part, is entirely beyond seal 14. The fluid contained in chamber 10, which is then closed off at its upper part and at its lower part, prevents any additional penetration of primary piston 8 and this is how the latter carries along the body 9. Tool 16, connected to secondary piston 15 which remains in the upper position in chamber 12 is lowered until it comes in contact with part 25 after having described an approach stroke C (indicated in FIG. 1).

When contact has been established between tool 16 and part 25 (see FIG. 2), body 9 and tool 16 become immobilized. By increasing slightly the stress exerted on stem 4, the pressure of the fluid in chamber 10 increases and reaches a threshold such that the effect of spring 32 of clack 31 is cancelled and allows fluid to flow along arrow 33 (FIG. 3), through the inside of clack 29, in the direction of channel 11. Because the channel is connected to the expansible casing 19, the latter will swell and induce the axial immobilization of body 9, to which it is connected, with respect to tube 2 and therefore with respect to frame 1.

Figure 3:
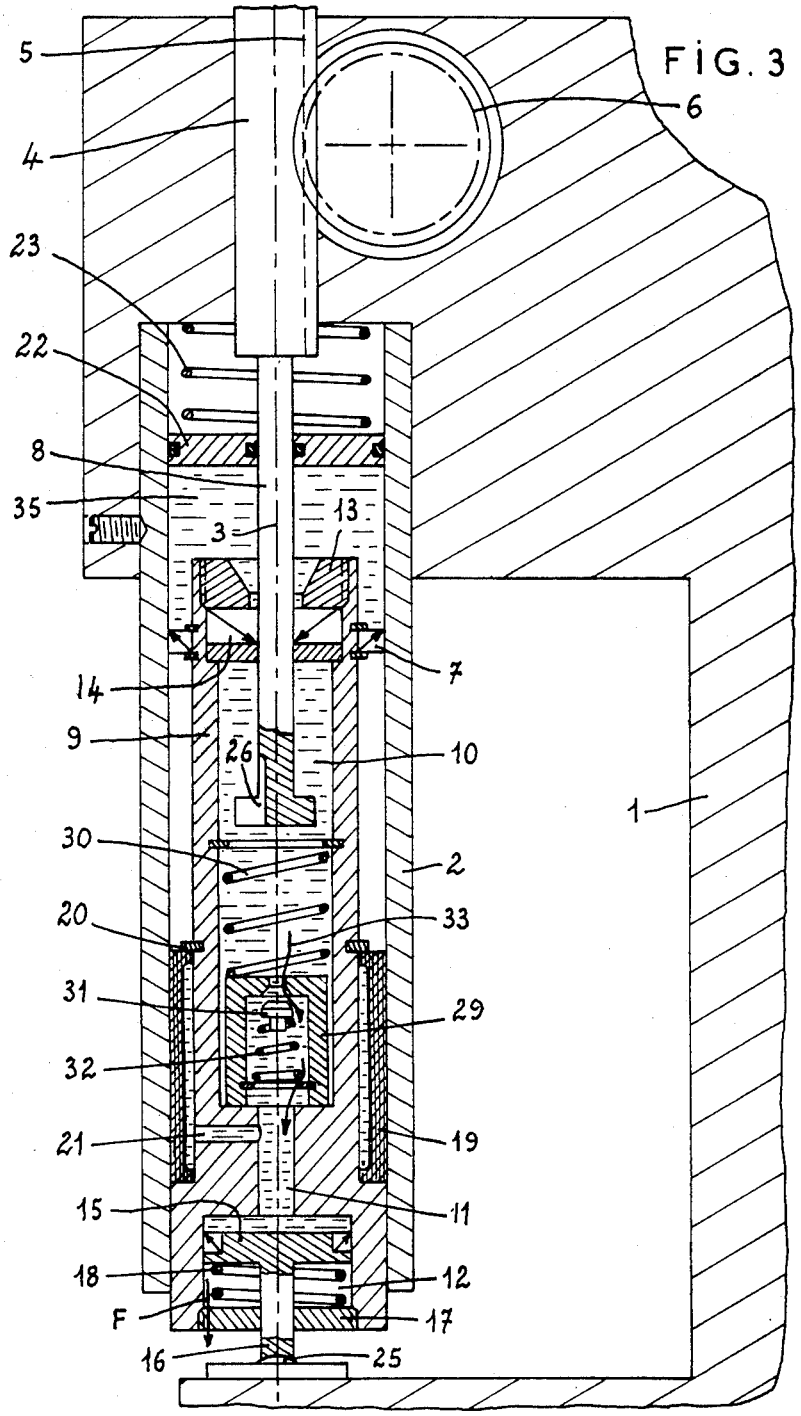

Beyond a certain pressure threshold, which is a function of the adjustment of spring 18, secondary piston 15 is displaced downwards in chamber 12 of body 9 which remains immobilized and it pushes tool 16 against part 25 to be pressed (see FIG. 3).

The section of secondary piston 15 is such that the stress F resulting from the pressure applied on this piston remains slightly below the blocking force of body 9 with respect to tube 2. This stress F, due to the fact that the section of secondary piston 15 is larger than that of primary piston 8, will, on the other hand, be greater than the stress applied on stem 4, which is indeed the effect desired (achievement of a small work stroke with a large developed stress).

Figure 4:
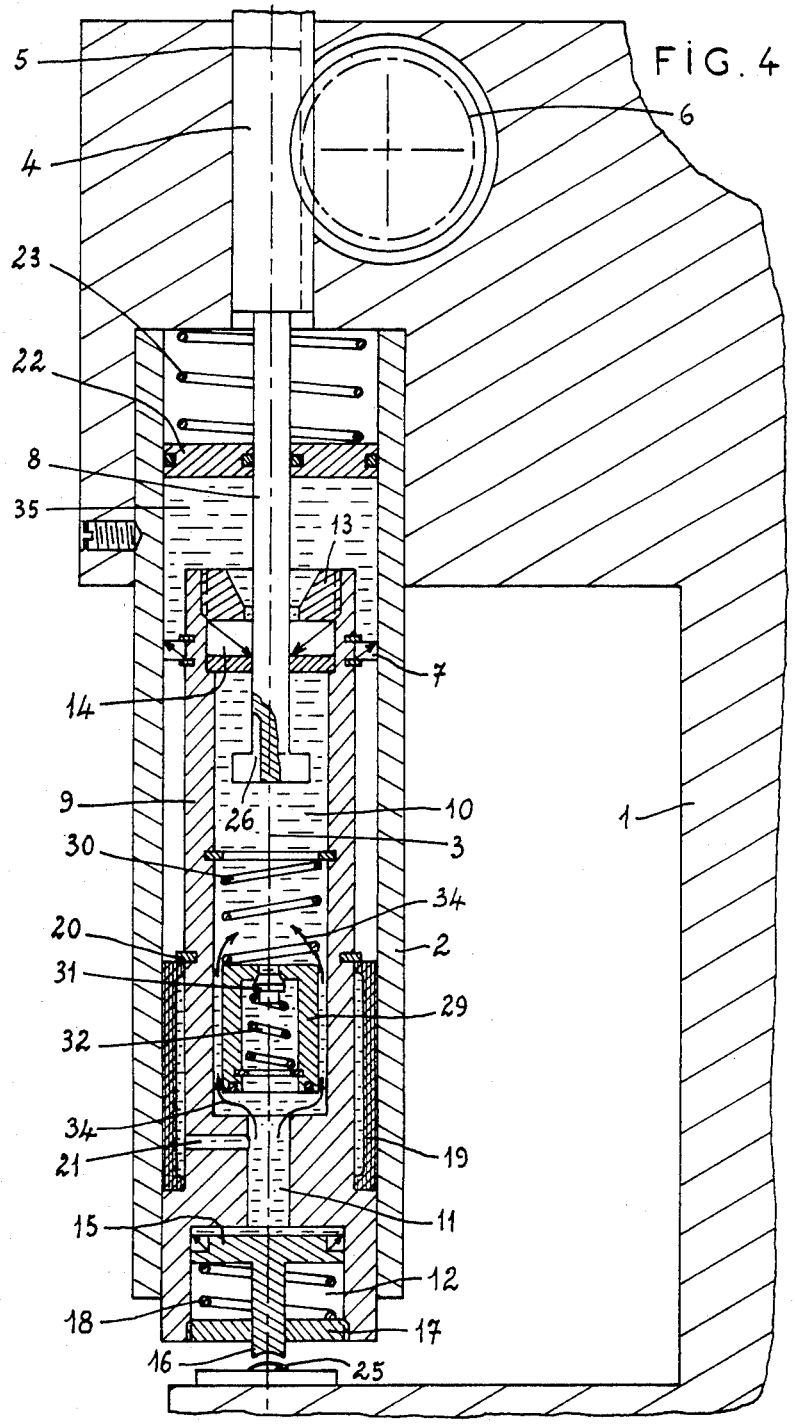

After having thus carried out the flattening or other operation on part 25, stem 4 is raised through an inverse rotation of pinion 6. Primary piston 8, rising with stem 4, induces a slackening of the pressure on secondary piston 15. The latter returns backwards in chamber 12 under the upward urging action exerted by spring 18. Similarly, the lowering of the pressure inside expansible casing 19 induces its contraction. The casing thus makes body 9 free to move with respect to tube 2. The fluid, flowing back from casing 19 and from chamber 12 of secondary piston 15, raises clack 29 and thus passes around it in the direction of chamber 10 along the path already defined by arrows 34 (FIG. 4).

When primary piston 8 reaches its upper position (FIG. 1), groove 26 which it comprises on its lower part puts into communication chamber 10 and chamber 35; in this way, the slightest leak which might have occurred during the previously described cycle is compensated by a supply of fluid pushed by movable end part 22 and by a spring thereof 23 outside chamber 35, in the direction of chamber 10.

Furthermore, primary piston 8, because of the shoulder it also comprises on its lower part, carries along with it upwards, body 9, which thus takes up its starting position. When the circulation of fluid from casing 19 and chamber 12 towards chamber 10 has ended, clack 29 takes up its resting position again by closing off the entrance to channel 11. The device is thus ready to perform another work cycle.

Figure 5:
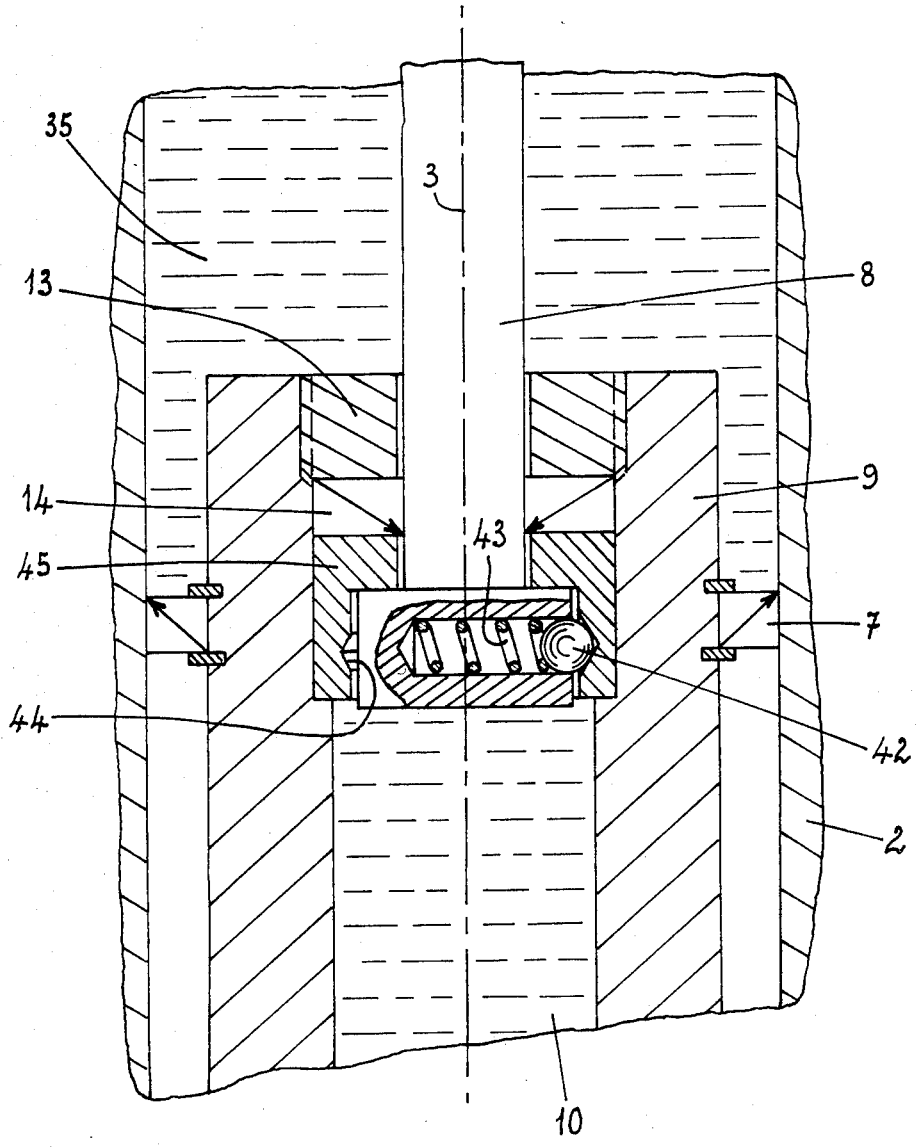
FIG. 5 is a partial sectional view, to an enlarged scale, of an embodiment with mechanical locking with a ball of the primary piston with respect to the body.

In the embodiment shown in FIG. 5, the temporary link between primary piston 8 and body 9 is effected using a mechanical locking device, a ball locking device, for example, comprising in this case a ball 42 housed in a bore provided radially in the lower part of piston 8 and also receiving a spring 43 which tends to push ball 42 towards the outside of its housing.

In the upper position of piston 8, this ball 42 is partially housed in a recess 44 of an annular part 45 below seal 14 and which is fixed with respect to body 9. After the approach phase during which, because of this locking device, stem 4 has carried along body 9, the latter being stopped, ball 42 is rendered ineffective, as it is cammed out of recess 44 and it allows piston 8 to place the hydraulic circuit under pressure in accordance with the previously described cycle.

Figure 6:
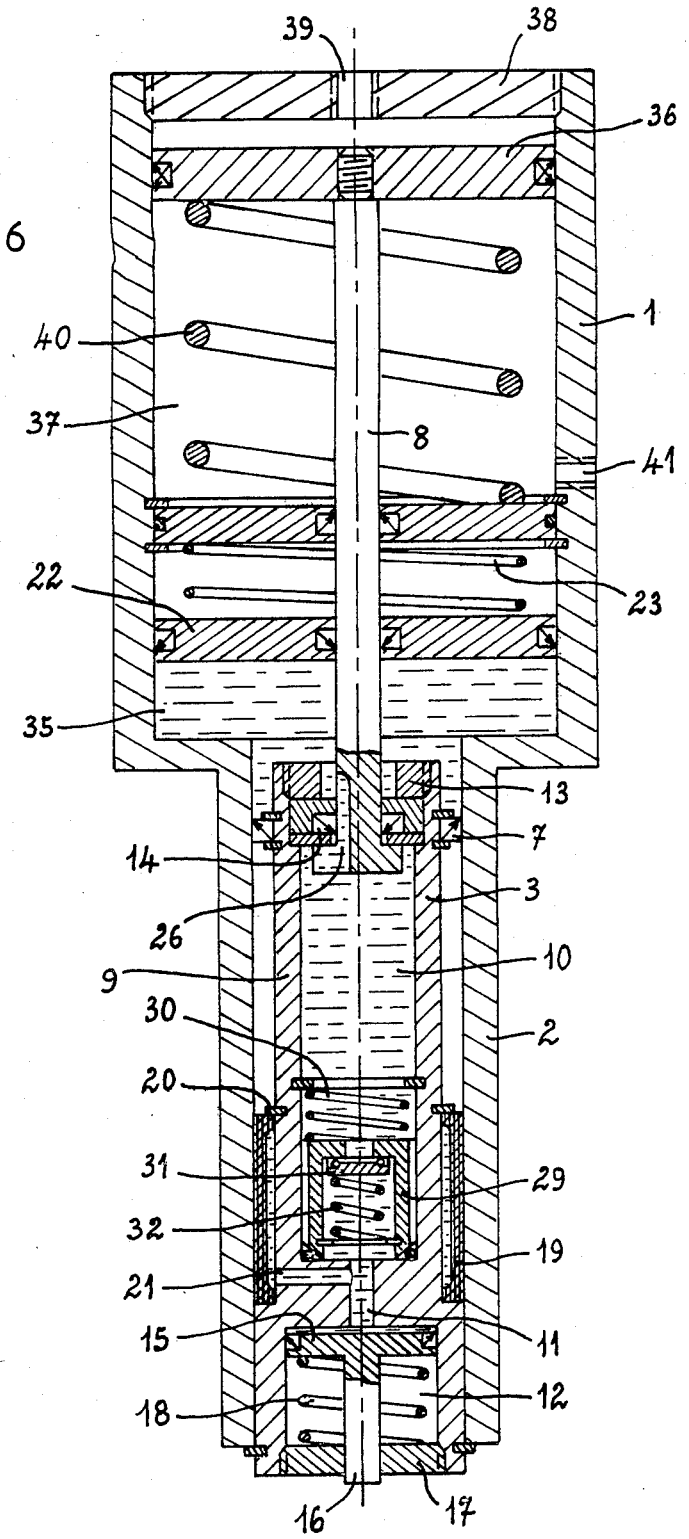
FIG. 6 is a sectional view of the mechanism according to the invention, in another varying embodiment in which the control of the stem is effected through an additional piston driven by compressed air or any other fluid.

In a second embodiment shown in FIG. 6, displacement of the stem of primary piston 8 is obtained through an additional piston 36, attached to the upper part of piston 8 and slidingly mounted inside a cylinder 37 placed along axis 3 in the upper region of tube 2 which acts as a guide for body 9 as well as a bearing surface for expansible casing 19. This cylinder 37 is closed off on its upper part by a cover 38.

Piston 36 is actuated by a pneumatic or hydraulic fluid, admitted into the upper chamber of cylinder 37 through an opening 39 in cover 38 and it is returned to a resting position by a spring 40 housed in the lower chamber of cylinder 37, or by any fluid introduced into this same chamber through opening 41.

The assembly thus obtained constitutes a fast advance and end of stroke force multiplication jack one important advantage of which is that, whatever the position of the part to be pressed 25 may be with respect to frame 1 (within the limit of the stroke of body 9), the final stress exerted will be the same and will depend directly on the pressure of the control fluid acting on piston 36.

Figure 7:
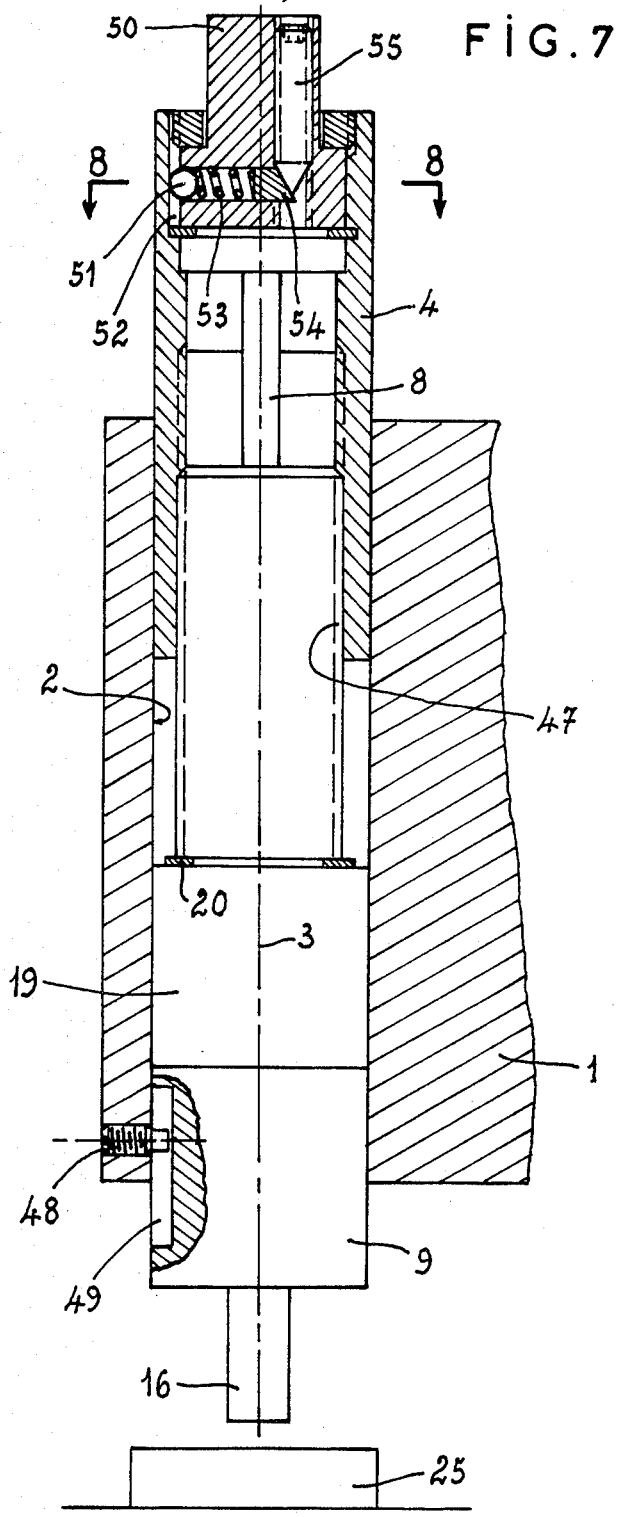
FIG. 7 is a partial sectional view of another embodiment, with a control through combined translation and rotation.
Figure 8:
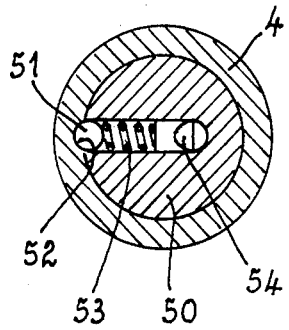
FIG. 8 is a section along line 8—8 of FIG. 7.

According to a further embodiment shown in FIGS. 7 and 8, a tube 4 is connected to body 9 through a thread 47, these two members being slidingly mounted in a bore 2 of frame 1. Body 9 is immobilized in this case in rotation with respect to frame 1, for example, by means of a screw 48 engaged in a groove 49 of body 9. Tube 4 can, on the contrary, rotate around axis 3 and can be manoeuvred through a part 50 mounted on the top thereof.

This part 50 is linked in rotation with tube 4 through a torque limiting device which comprises:

a ball 51 housed in a radial bore of part 50;
an internal groove 52 of tube 4;
a spring 53 pushing ball 51 into groove 52;
a guide-rod 54 on which spring 53 rests; and
an adjusting screw 55, parallel to axis 3, and screwed into part 50 the tip of this screw 55 co-operating with an inclined face of guide-rod 54, in order to compress, more or less, spring 53.

Tube 4, comprising the control member, undergoes a displacement having two different patterns:

In the first place, it describes a translation which is accompanied by a translation of body 9 on which it is temporarily locked and which brings tool 16 in contact with the part to be pressed 25. This first phase, corresponding to the approach stroke, is not any different from that already described above.

In a second phase, tube 4, manoeuvred through part 50, is rotated and therefore screwed onto body 9, which remains immobilized in the rotation sense. As a result of this operation tube 4 penetrates into bore 2 and carries along with it downwards primary piston 8 which is integral with said tube. As before, the downstroke of piston 8 in the hydraulic circuit increases the pressure in the latter and results, on the one hand, in the blocking of body 9 with respect to the frame, by inflation of expansible casing 19 and, on the other hand, in the motion of tool 16 against the part to be pressed 25. The torque limiting device, associated with part 50, makes it possible to limit the pressing force of tool 16 on part 25.

This latter embodiment makes it possible, with a relatively low screwing torque, and for example exerted by hand, to obtain an already amplified stress on primary piston 8, as a result of the effect of threading 47, this stress being in turn amplified by secondary piston 15 pushing tool 16.

The pressing mechanism described above has applications, in particular, in the field of marking and riveting and it can be controlled, depending on the sources of energy available and the stresses to be provided, by manual, mechanical, hydraulic, pneumatic or other actuating means, acting on stem 4. Other applications may be contemplated in the field of clamping where a fast advance, followed by a substantial tightening stress, is often desired.

I claim:

1. A hydraulic press mechanism for applying in succession a fast approach stroke to a tool juxtaposed with a workpiece and then a work stroke with substantial stress application to the workpiece, said mechanism comprising:

a housing formed with a bore axially aligned with said tool;

a main body centered on the axis of said bore and received in and axially movable along said bore, said body being formed at an end proximal to said tool with a cylindrical chamber centered on said axis and at an end remote from said tool with a compartment centered on said axis receiving a substantially incompressible fluid, said compartment being connected to said chamber through a passage in said body extending along said axis;

a secondary piston centered on said axis received in said chamber and operatively connected with said tool for displacing said tool axially toward said workpiece upon hydraulic pressurization of said chamber;

a primary piston centered on said axis and axially shiftable in said housing and extending into said compartment of said body for displacement of fluid from said compartment through said passage to said chamber;

coupling means for releasably coupling said body to said primary piston whereby displacement of said primary piston and said body towards said workpiece displaces said secondary piston with said fast approach stroke until said tool contacts said workpiece;

an expansible casing on said body centered on said axis and exposed to said fluid for expansion by fluid pressure upon engagement of said tool with said workpiece for blocking said body against said housing whereby further displacement of said primary piston into said compartment displaces fluid therein to displace said secondary piston with said work stroke;

control means including a stem extending along said axis and operatively connected with said primary piston for displacing same, and an actuator displaceable in opposite directions for said stem, said secondary piston being biased by a return spring in said body away from said workpiece; and sealing means for isolating said actuator from said fluid.

2. The mechanism defined in claim 1 wherein said coupling means includes a pressure-controlled valve displaceable along said axis between said compartment and said passage for blocking flow of said fluid from said compartment to said passage and thereby limiting the penetration of said primary piston into said compartment.

3. The mechanism defined in claim 2 wherein said valve includes a pair of clacks, one of said clacks being oriented to permit fluid to flow back from the expansible casing and said chamber to said compartment, another of said clacks permitting flow from said compartment toward the expansible casing and said chamber.

4. The mechanism defined in claim 1 wherein said coupling means includes a spring biased ball locking said primary piston to said body releasably.

5. The mechanism defined in claim 3 wherein said control means includes a rack connected to said stem and a pinion meshing with said rack and rotatable to displace said stem.

6. The mechanism defined in claim 3 wherein said housing is provided with a cylinder coaxial with said bore, said actuator comprising an additional piston displaceable by fluid pressure in the last mentioned cylinder and operatively connected to said primary piston for displacing same.

7. The mechanism defined in claim 1 wherein said stem comprises a control tube slidingly mounted and rotating within said bore of said housing, a threaded member linking said control tube to said body, means immobilizing said body against rotation, and a torque limiting device connected to said tube to enable the maneuvering thereof whereby the approach stroke is effected by simultaneous translation of said tube and said body while said work stroke is effected by rotation of the tube relative to said body.

8. The mechanism defined in claim 3 wherein said primary piston is formed at an extremity immersed in said compartment with a groove such that when the primary piston is in a retracted position from the compartment, said groove connects said compartment and a hydraulic fluid reserve and when said primary piston is advanced, the connection of said compartment and said reserve is blocked, said reserve being delimited in said bore by said sealing means, which sealing means comprises a movable wall biased by a spring to obtain an automatic compensation for variation in the volume of said fluid in said reserve.

* * * * *